US008105216B2

(12) United States Patent
Hazan et al.

(10) Patent No.: US 8,105,216 B2
(45) Date of Patent: Jan. 31, 2012

(54) EXERCISE DEVICE FOR STOMACH MUSCLES

(76) Inventors: Haim Hazan, Yerucham (IL); Gilad Janklowicz, Honolulu, HI (US)

( * ) Notice: Subject to any disclaimer, the term of this patent is extended or adjusted under 35 U.S.C. 154(b) by 0 days.

(21) Appl. No.: 12/103,479

(22) Filed: Apr. 15, 2008

(65) Prior Publication Data

US 2008/0254957 A1 Oct. 16, 2008

(30) Foreign Application Priority Data

Apr. 16, 2007 (IL) ..... 182561
Sep. 9, 2007 (IL) ..... 185809

(51) Int. Cl.
*A63B 21/04* (2006.01)
*A63B 26/00* (2006.01)

(52) U.S. Cl. ..... 482/129; 482/140

(58) Field of Classification Search ..... 482/34, 482/129, 130, 132, 140, 38, 142, 143, 141; 472/135; 297/338, 423.42, 423.45
See application file for complete search history.

(56) References Cited

U.S. PATENT DOCUMENTS 1,509,750 A * 9/1924 Campbell ..... 482/26
1,950,042 A * 3/1934 Upper ..... 297/136
3,053,535 A * 9/1962 Gabrielson ..... 472/135
3,130,968 A * 4/1964 De Feen ..... 482/132
3,173,415 A * 3/1965 Rubin ..... 601/49
3,701,529 A * 10/1972 Kruthaupt et al. ..... 482/123
D262,394 S * 12/1981 Hain ..... D21/691
4,924,531 A * 5/1990 Square ..... 4/667
5,224,914 A 7/1993 Friedman
5,295,930 A 3/1994 Hogan
5,387,171 A * 2/1995 Casey et al. ..... 482/130
5,407,404 A 4/1995 Killian et al.
5,542,898 A 8/1996 Wilkinson
5,547,442 A * 8/1996 Carballosa et al. ..... 482/46
D376,397 S 12/1996 Prodan
5,616,106 A 4/1997 Abelbeck
5,637,062 A 6/1997 Schmittner
5,653,667 A 8/1997 Reyes
5,704,882 A * 1/1998 Coates et al. ..... 482/69
5,728,031 A 3/1998 Honeycutt
5,759,138 A 6/1998 Boland
5,776,039 A 7/1998 Perez
5,816,983 A * 10/1998 Dawes et al. ..... 482/78
5,913,756 A 6/1999 Glaser
5,964,685 A 10/1999 Boland
6,024,679 A * 2/2000 Castallanos et al. ..... 482/140
6,048,294 A 4/2000 Formanek
6,053,851 A 4/2000 Tu
6,117,057 A 9/2000 Olschansky et al.
6,129,693 A * 10/2000 Peterson ..... 602/32
6,206,809 B1 3/2001 Habing et al.
6,283,900 B1 9/2001 Tornabene
6,296,598 B1 10/2001 Boland
6,488,614 B1 12/2002 Chang (Continued)

*Primary Examiner* — Allana Lewin
(74) *Attorney, Agent, or Firm* — Lucas & Mercanti, LLP

(57) ABSTRACT

A free-standing exercise device is disclosed for exercising the abdominal muscles of a user being in a substantially upright position. The exercise device includes a base structure, an upper structure, two handles and a beam element. The beam element is suspended by tensioning means and is configured, positioned and sized to directly engage the abdomen when the user grasps the handles and pulls himself or herself forward and backward relative to the handles. The exercise device may further include a skateboard or roller device to facilitate the forward and backward movement by the user.

16 Claims, 4 Drawing Sheets

U.S. PATENT DOCUMENTS 6,575,884 B1 6/2003 Eazor
6,626,808 B1 9/2003 Adams
6,634,997 B2 * 10/2003 Breibart et al. ..... 482/130
6,676,573 B2 1/2004 Abelbeck et al.
6,758,792 B1 7/2004 Chang
6,932,749 B2 8/2005 Barnes et al.
6,966,871 B2 11/2005 Parmater
7,044,899 B2 5/2006 Kuo
7,060,014 B2 6/2006 Bergman et al.
7,063,651 B2 6/2006 Kerry
7,125,366 B1 10/2006 Yeh
7,137,933 B2 11/2006 Shifferaw
7,137,934 B2 11/2006 Paramater
7,144,352 B2 12/2006 Hazan
7,235,040 B2 6/2007 Chung-Ting
7,303,508 B2 12/2007 Toyama et al.
7,309,303 B1 12/2007 Proctor
2004/0209751 A1 10/2004 Thonn, Jr.
2006/0014614 A1 1/2006 Szabo et al.
2006/0100070 A1 5/2006 Abdo
2007/0037677 A1 * 2/2007 Splane ..... 482/121
2007/0082792 A1 4/2007 Gebelein
2007/0259760 A1 11/2007 Perez

* cited by examiner

EXERCISE DEVICE FOR STOMACH MUSCLES

The present invention relates to exercise equipment.

More particularly, the invention provides a device which is operated with the user in a standing position to exert pressure on the stomach and its muscles while at the same time providing exercise for the arm muscles.

Possibly because of car use to traverse even short distances, TV viewing and the consumption of junk food, there is a well-known tendency in developed countries towards a population that is increasingly becoming overweight and obese. Many are aware of the health dangers therein, such as, but not limited to, diabetes, stroke and heart failure, and subject themselves to diets and/or more exercise. While many exercises can be performed without any equipment, nevertheless a large market has developed for exercising machinery such as stationery bicycles, treadmills, rowing machines, step-climbing machines and others.

Exercise devices for the abdominal muscles have long been known. Basically there are two types of device: those which are hand held and others which are floor supported.

"Push ups", much favored by armed forces world wide, requires lying in a horizontal position and then raising the body in a substantially straight line by pressing the hands on the floor surface and straightening the arms. Young healthy people of average weight can do "push ups" without help from any equipment. Those who do not qualify as such can perform push ups with the aid of a device such as is disclosed in U.S. Pat. No. 7,144,352 to Hazan.

Further devices are available wherein the body of the user is at a slope of about 45° to the horizontal during exercising. None of these devices is suitable for elderly people or those who are in most need of exercise—the overweight and/or those in poor physical condition.

The state of the art can be derived from a review of recent U.S. patents.

A muscle enhancement exerciser disclosed by Glaser in U.S. Pat. No. 5,913,756 is of the hand-held type, and has no supporting frame, and is thus likely to be used by people who already are in good physical shape. The same applies to the Body exerciser in U.S. Pat. No. 6,053,851 to Tu, and to the Cycle type waist slimmer proposed by Chang in U.S. Pat. No. 6,488,614.

Formanek discloses a C-shaped bar in U.S. Pat. No. 6,048,294 which is intended to be hand gripped by an exercising person while doing push-ups. The bar may be freestanding, on its own support stand, or connected to a prior art exercise framework.

The exercise apparatus disclosed by Tomabene in U.S. Pat. No. 6,283,900 B1 lifts the user off the ground in response to pressure on the backrest, for exercising three muscle groups. This device is not suitable for the elderly.

A portable lap-based exercising device is disclosed by Boland in U.S. Pat. No. 6,296,598. Various exercises may be carried out while the user is sitting on a chair unconnected to the device.

Among devices already available commercially from the Pilates company is a model named Classic Cadillac which comprises a structure similar to a hospital bed, equipped with various overhead bars, straps, springs and levers to be manipulated by a lie-down user. The device is claimed to allow over 80 different exercises, but is too expensive and too large for the average home.

There is therefore a need for a device that allows people to exercise while in a standing position while simultaneously exercising the arm and abdominal muscles.

It is therefore one of the objects of the present invention to obviate the disadvantages of prior art exercise machines and to provide a floor-supported device which exercises the abdominal muscles.

It is a further object of the present invention to provide an exerciser that is not too costly and suitably sized for home use.

The present invention achieves the above objects by providing a free-standing exercise device for exercising the abdominal muscles of a user being in a substantially upright position, comprising:

a. a base lower structure;

b. two elevated, substantially stationary spaced-apart handles supported by an upper structure above and connected to said base lower structure, and c. a beam element freely suspended by tensioning means extending from a pair of spaced-apart support elements extending from said upper structure, said beam element being suspended along a horizontal plane vertically lower than the horizontal plane passing through said handles, said beam element further being suspended in a spaced-apart position between said handles and a position to be assumed by said user, said beam element being configured, positioned and sized to directly engage the abdomen of said user, who may exercise by pulling him/herself forwards and backwards relative to said handles while grasping the same while in a substantially upright position.

In preferred embodiments of the present invention, said tensioning means are formed from a continuous loop of elastomeric material.

In some preferred embodiments of the present invention said tensioning means are formed from a band of rubber.

In other preferred embodiments of the present invention there is provided a free-standing exercise device for exercising the abdominal muscles of a user who is substantially in an upright position, comprising:

a. a base lower structure;

b. two elevated, substantially stationary spaced-apart handles supported by an upper structure above and connected to said base lower structure, and c. a beam element freely suspended by a pair of spaced-apart spring elements from said upper structure, said beam element being suspended along a horizontal plane closely adjacent to a horizontal plane passing through said handles, said beam element further being suspended in a spaced-apart position between said handles and a position to be assumed by said user, said beam element being configured and sized to directly engage the abdomen of said user, who may exercise by pulling him/herself forwards and backwards relative to said handles while grasping the same while in a substantially upright position.

In a preferred embodiment of the present invention there is provided a free-standing exercise device wherein the height of said upper structure can be adjusted relative to said base lower structure.

In another preferred embodiment of the present invention there is provided a free-standing exercise device wherein there is further provided a pair of support pads for the forearms of the user, said pads being rigidly attached to said upper structure.

In another preferred embodiment of the present invention there is provided a free-standing exercise device wherein there is further provided a chin support pad rigidly attached to said upper structure and disposed between said handles.

In yet a further preferred embodiment of the present invention there is provided a free-standing exercise device wherein at least one of the components in direct contact with the user is padded with a resilient material.

In another preferred embodiment of the present invention there is provided a free-standing exercise device in combination with a skate-board like device to support the user and to facilitate the forward and backward movement of said user while in contact with said beam element.

In a most preferred embodiment of the present invention there is provided free-standing exercise device in further combination with said skate-board like device and in combination with a rail element sized and configured to be positioned on a floor substantially perpendicular to a vertical plane passing through said pair of spaced-apart handles and to guide the wheels of said skate-board like device.

It will be realized that the novel exerciser of the present invention can be manufactured as a fixed framework, where the structural members have welded joints, or the device can be made for easy assembly and dismantling in which case fasteners will be used instead of welding. The welded joint structure provides greater rigidity at lower cost, while the take-apart version is easier to store and transport. The following description and attached drawings are to be interpreted as including both types of construction.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
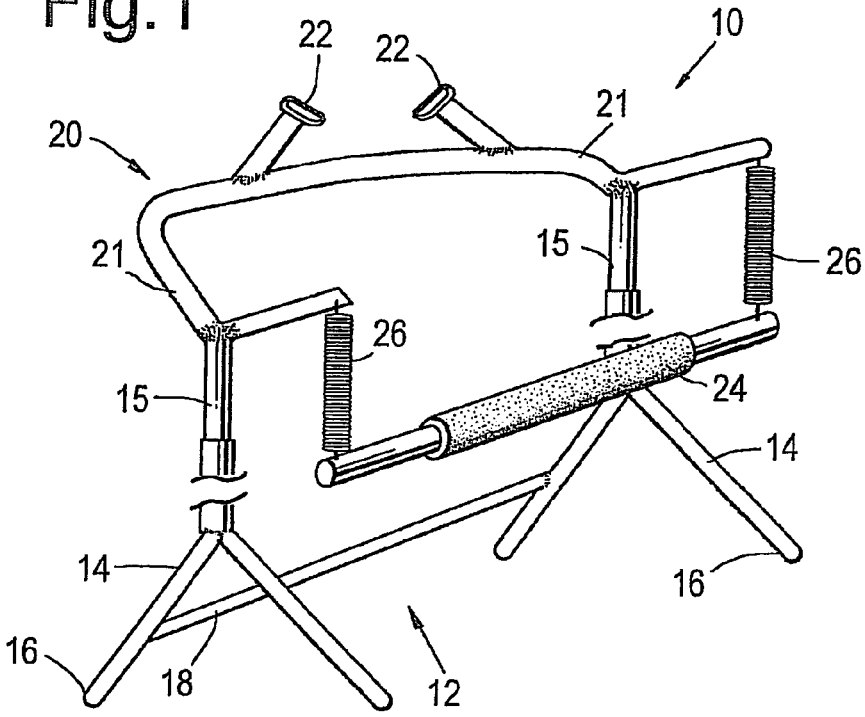
FIG. 1 is a perspective view of a preferred embodiment of the exerciser according to the invention.
Figure 2:
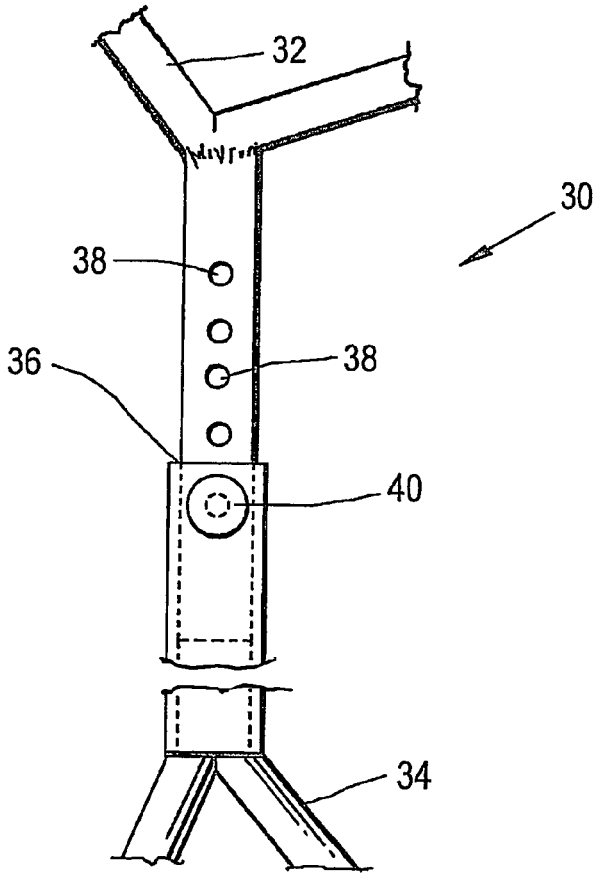
FIG. 2 is a detail of an elevational view of a height-adjustable embodiment.

There is seen in FIG. 1 a free-standing exercise device 10 for exercising the abdominal muscles of a user who may exercise while being in a standing position. The device seen has a base lower structure 12 including four legs 14 each with a footpad 16. A rear stabilizer beam 18 retains the leg structure. An upper structure 20 is supported above, and is connected to the base lower structure 12. Both the lower and the upper structure 12, 20 can be made of round-section steel tubing. Two elevated fixed position spaced-apart handles 22 are supported at a suitable height by the upper structure 20. The handles 22 are preferably tilted inwards towards the center of the upper structure 20 at about a 45° angle.

A beam element 24 is freely suspended from the upper structure 20 by a pair of spaced-apart spring elements 26, that are suitably closely coiled steel tension springs, said beam element 24 being suspended along a horizontal plane closely adjacent to a horizontal plane passing through said handles 22, said beam element further being suspended in a spaced-apart position between said handles 22 and a position (not shown) to be assumed by said user, said beam element being configured and sized to directly engage the abdomen of said user, who may exercise by pulling him/herself forwards and backwards relative to said handles 22 while grasping the same and while in a substantially upright position. Thus, the beam element 24, is displaced towards upright elements 15 of the upper frame structure 20 by the abdomen of a user as the user pulls him/herself towards handles 22 against the resistance of element 24 and springs 26.

In its released hanging state, the beam element 24 is preferably disposed at a height lower than the height at which the handles are positioned on the upper frame element 20 and thereby are configured and sized to directly engage the abdomen of the user when the user exercises by grasping the handles 22 and pulling him/herself forwards and backwards relative thereto. As will be realized, in this manner of exercise, the user remains substantially in an upright (standing) position and achieves interaction between abdominal muscles and the spring resistant element 24 without needing to be capable of executing push ups in an inclined standing position as required for the utilization of the device of earlier U.S. Pat. No. 7,144,352.

As will be noted, upper frame element 20 is of an open U-like construction with arms 21 facing the direction of the user and being spaced-apart in such a way that the user can freely move forwards and backwards relative to handles 22, with beam element 24 not only pressing against the abdomen of the user, but also serving as a support therefore while moving in contact and conjunction with the user, thereby assuring that the user remains substantially straight and does not twist or assume an unhealthy curvature of the back area.

With regard to the rest of the figures, similar reference numerals have been used to identify similar parts.

Referring now to FIG. 27 there is seen a detail of a free-standing exercise device 30 wherein the height of the upper structure 32 can be adjusted relative to the base lower structure 34. In the shown embodiment there is shown a tube-in-tube joint 36 connecting the two structures. A series of vertically spaced-apart apertures 38 can be aligned at various positions and are retained at the chosen height by the insertion of a removable pin 40. Other clamping methods are also feasible, for example the pinch clamp (not shown) having a clamping screw external to the tubes. Thus the exerciser 30 is easily adjusted to suit the height of any user.

Figure 3:
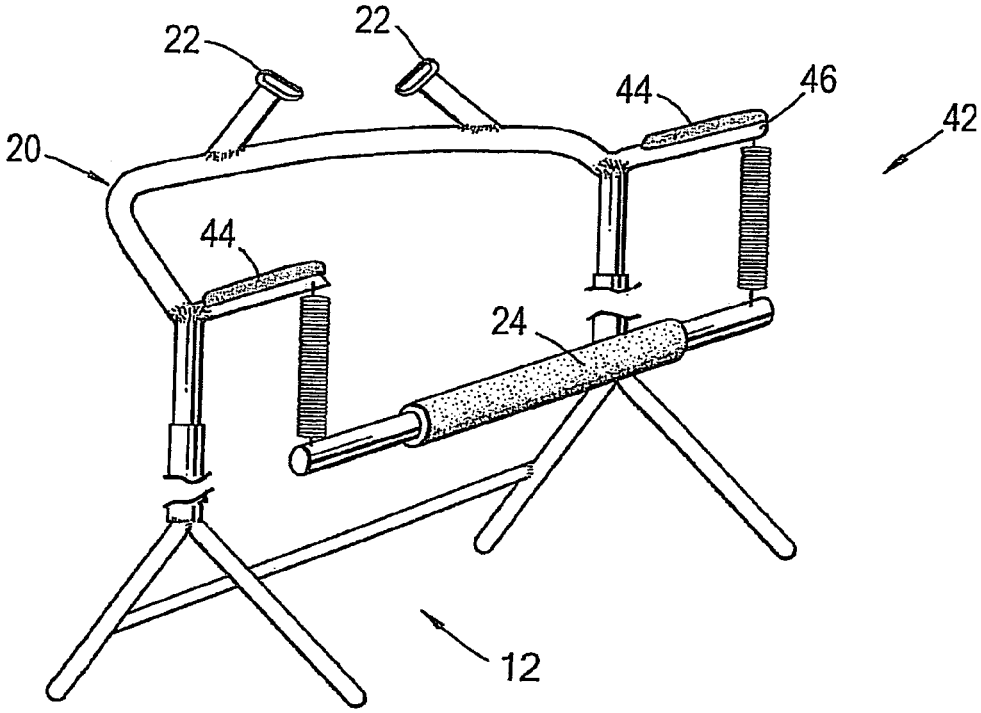
FIG. 3 is a perspective view of an embodiment including arm rests.

FIG. 3 an embodiment 42 further provided with a pair of support pads 44 for the forearms of the user. Each support pad 44 is rigidly attached to a beam 46 of the upper structure 20.

In operation the pads 44 serve to allow an increase in the pressure the user can exert on the horizontal beam element 24.

Figure 4:
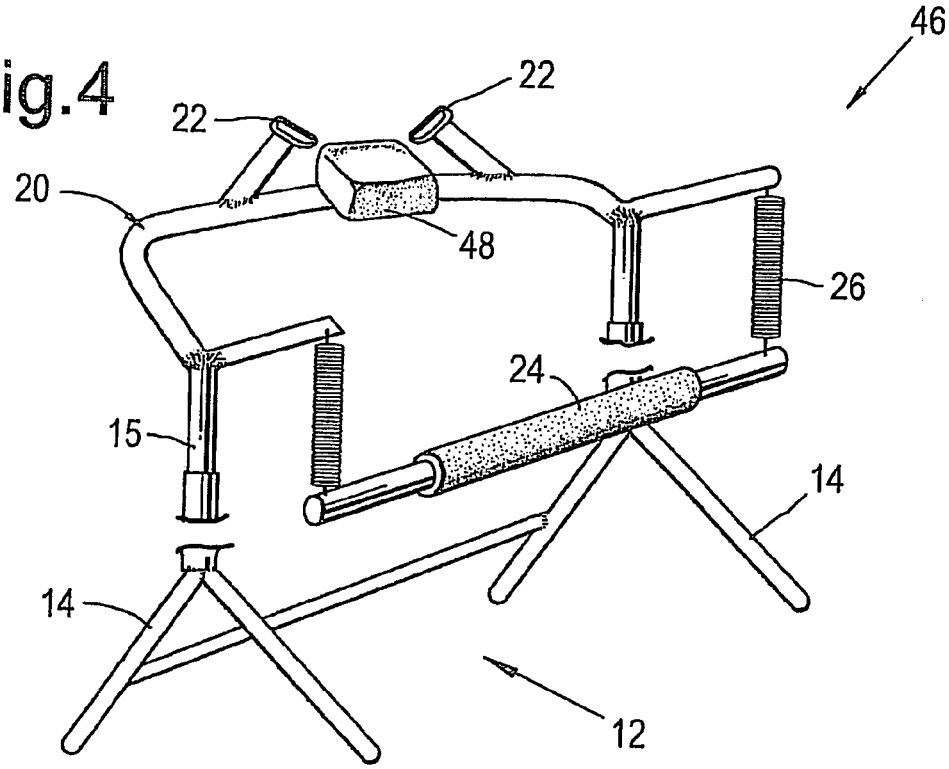
FIG. 4 is a perspective view of an embodiment including a chin support pad.

Seen in FIG. 4 is an embodiment of the device 46 wherein there is further provided a chin support pad 48 rigidly attached to the upper structure 20 and disposed between the handles 22. The pad 48 further enables the user to apply some extra abdominal pressure while exercising as well as providing for greater comfort of the user while utilizing the device.

The components in direct contact with the user, such as the horizontal beam 24, the arm support pad 44 seen in the previous figure and the chin support pad 48 are padded with a resilient material, for example a polyurethane flexible foam, a rubber based foam or other materials having similar properties. The padding allows a user to increase his/her efforts as the force applied by the body of the user is spread over a larger area as well as increasing the comfort of the user while using the device.

Figure 5:
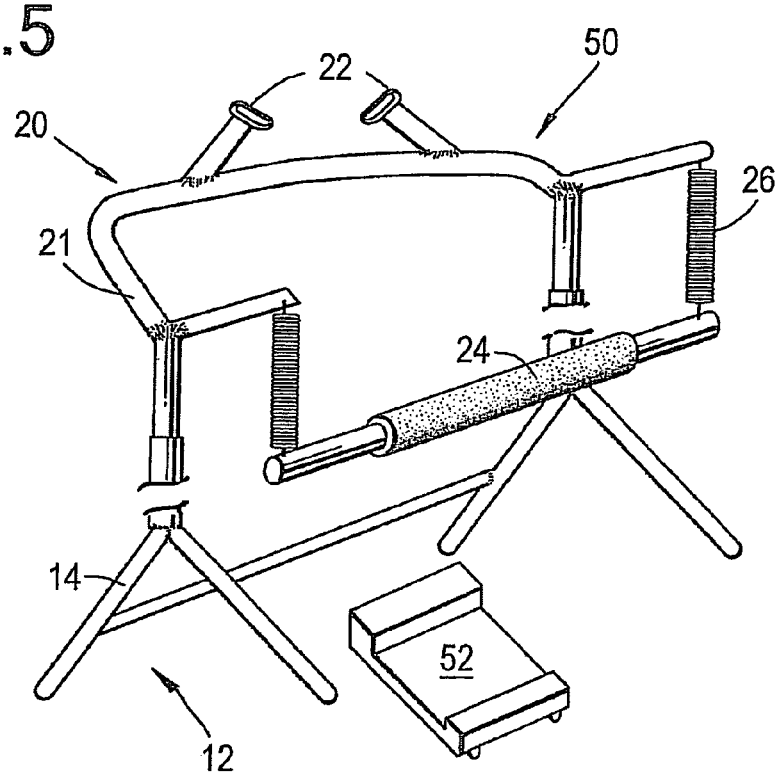
FIG. 5 is a perspective view of an embodiment wherein a rollable support carriage is provided for the feet of the user.

Referring now to FIG. 5, there is seen a free-standing exercise device 50 in combination with a skate-board like device 52 which serves as a foot carriage to support the user.

As the exercise is carried out by forward and rearward movement of the user who is to remain substantially upright during the course of said movement, it follows that the feet of the user must move horizontally relative to the floor surface. In this preferred embodiment, the user stands on the board 52 with both feet and the ready movement of the board facilitates the forward and backward movement of the user while in contact with the beam element 24 as the user propels him/herself forward and backward by alternately pulling on the handles against the resistance of the spring 26 supported beam element 24 and pushing thereagainst.

FIG. 6 again shows the exercise device 50 seen in FIG. 5 in further combination with a rail element 52 configured to be positioned on a floor. The rail element is substantially perpendicular to a vertical plane passing through the pair of spaced-apart handles 22. The rail element 52 guides the wheels of the skate-board-like device 52. The rail element can comprise a metal roll-formed profile or a plastic extrusion. Advantageously a plurality of rubber pads 54 or suction cups is attached underneath the rail element 52 to prevent unintended movement thereof.

Figure 6:
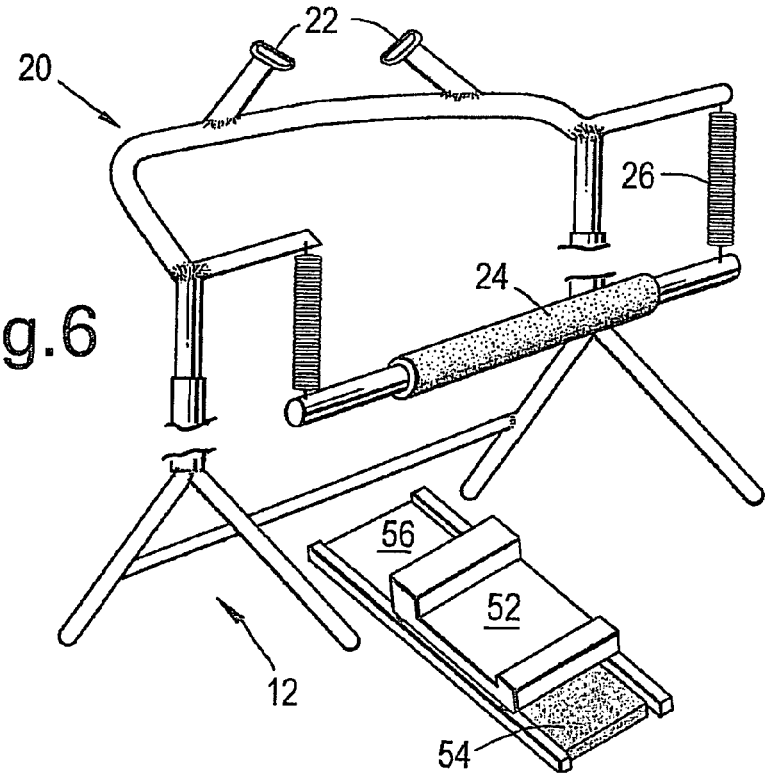
FIG. 6 is as FIG. 5 wherein a track member is provided for the carriage.
Figure 7:
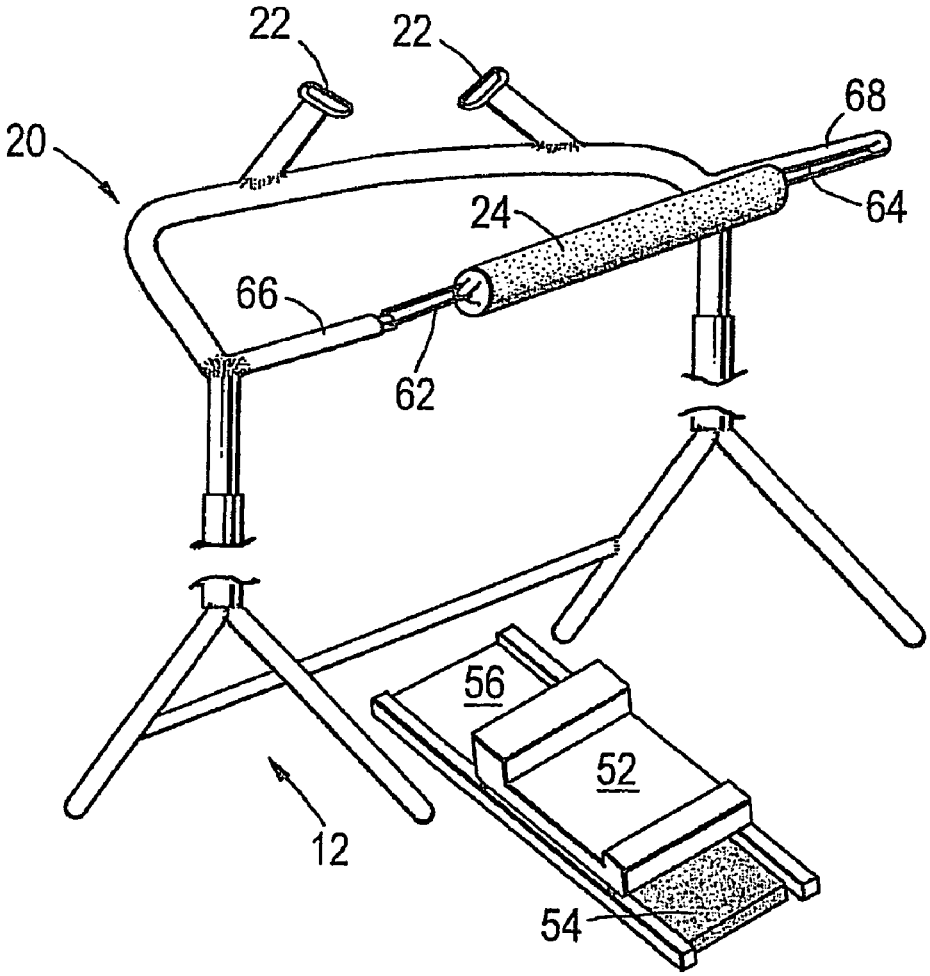
FIG. 7 is a perspective view of another preferred embodiment wherein the tensioning means are formed from a continuous belt of elastomeric material.

Referring now to FIG. 7 in which similar reference numerals have been used to identify similar parts referred in FIGS. 5 and 6, it will noted that a beam element 24 is freely suspended from the upper structure 20 by a continuous loop 60 of elastomeric material such as rubber, said loop being hooked at its respective ends 62 and 64 to a pair of spaced-apart support elements 66 and 68 extending from said upper structure 20, said beam element 24 being suspended along a horizontal plane vertically lower than the horizontal plane passing through said handles 22, said beam element further being suspended in a spaced-apart position between said handles 22 and a position to be assumed by said user, said beam element being configured, positioned and sized to directly engage the abdomen of said user, who may exercise by pulling him/herself forwards and backwards relative to said handles 22 while grasping the same while in a substantially upright position.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A free-standing exercise device for exercising abdominal muscles of a user being in a substantially upright position, comprising:

a. a base lower structure;

b. an upper structure, which is located above said base lower structure and connected to said base lower structure, comprising a substantially U-shaped member, two elevated, substantially stationary spaced-apart handles fixed to and extending centrally from said U-shaped member, and two further members, one of said further members extending at an angle from one end of said U-shaped member and another of said further members extending at an angle from another end of said U-shaped member;

c. tensioning means formed from a continuous loop of elastomeric material extending from each of said further members of said upper structure; and d. a rod freely suspended by said tensioning means along a horizontal plane vertically lower than a horizontal plane passing through said handles, said rod further being suspended in a spaced-apart position between said handles and a position to be assumed by said user, said rod being configured, positioned and sized to directly engage an abdomen of said user, who may exercise by pulling himself/herself forwards and backwards relative to said handles while grasping the handles in a substantially upright position, and said rod being configured, positioned and sized to be displaced against a resistance of the tensioning means by the abdomen of the user as the user pulls himself/herself toward the handles.

2. The free-standing exercise device according to claim 1, wherein said tensioning means are formed from a band of rubber.

3. The free-standing exercise device according to claim 1, wherein a height of said upper structure is adjustable relative to said base lower structure.

4. The free-standing exercise device according to claim 3, wherein said upper structure is connected to said base lower structure by upright elements, said upright elements comprising a first tube, which has a plurality of vertically-spaced apertures, fixed to said upper structure a second tube, which has at least one aperture and a diameter which is greater than that of said first tube, fixed to said base lower structure, and a fastener extending through said aperture of said second tube and one of said apertures of said first tube.

5. The free-standing exercise device according to claim 1, further comprising a pair of support pads rigidly attached to said upper structure.

6. The free-standing exercise device according to claim 1, wherein further comprising a chin support pad rigidly attached to said upper structure and disposed between said handles.

7. The free-standing exercise device according to claim 1, wherein at least one component of said free-standing exercise device in direct contact with the user is padded with a resilient material.

8. The free-standing exercise device according to claim 1, further comprising a wheeled device to support the user and to facilitate a forward and a backward movement of said user while in contact with said rod.

9. The free-standing exercise device according to claim 8, further comprising a rail element sized and configured to be positioned on a floor substantially perpendicular to a vertical plane passing through said handles and to guide wheels of said wheeled device.

10. The free-standing exercise device according to claim 1, wherein said handles are tilted inwards towards a center of the U-shaped member at about a 45° angle.

11. The free-standing exercise device according to claim 1, wherein said base lower structure has a first leg, a second leg, a third leg and a fourth leg, said first leg and said second leg extend outwardly in opposite directions from one side of said device and said third leg and said fourth leg extend outwardly in opposite directions from another side of said device.

12. The free-standing exercise device according to claim 11, further comprising a stabilizer member fixed to said first leg and said third leg.

13. A free-standing exercise device for exercising the abdominal muscles of a user being in a substantially upright position, comprising:

a. a base lower structure;

b. an upper structure connected to and located above the base lower structure, said upper structure having a substantially U-shaped member and a further member attached to and extending at an angle from each end of said U-shaped member;

c. a handle attached to the upper structure;

d. tensioning means extending from said upper structure;

e. a rod freely and tensively suspended by said tensioning means from said upper structure, said rod being suspended along a horizontal plane vertically lower than the horizontal plane passing through said handle, said rod further being suspended in a spaced-apart position between said handle and a position to be assumed by said user, said rod being configured, positioned and sized to directly engage an abdomen of said user, who may exercise by pulling himself/herself forwards and backwards relative to said handle while grasping the same while in a substantially upright position; and f. a wheeled device supporting the user and facilitating a forward and a backward movement of said user while in contact with said rod.

14. The free-standing exercise device according to claim 13, wherein said rod is configured, positioned and sized to be displaced against a resistance of the tensioning means by the abdomen of the user as the user pulls himself/herself toward the handles.

15. A free-standing exercise device for exercising abdominal muscles of a user being in a substantially upright position, comprising:

a. base lower structure;

b. an upper structure located above said base lower structure, said upper structure comprising a substantially U-shaped member, two elevated, substantially stationary spaced-apart handles fixed to and extending from said U-shaped member, and two further members, one of said further members extending at an angle from one end of said U-shaped member and another of said further members extending at an angle from another end of said U-shaped member;

c. upright support elements connecting said base lower structure and said base upper structure;

d. a pair of spaced-apart spring elements attached to and extending from said further members; and e. a rod freely suspended by said spring elements from said further members of said upper structure, said rod being suspended along a horizontal plane closely adjacent to a horizontal plane passing through said handles, said rod further being suspended in a spaced-apart position between said handles and a position to be assumed by said user, said rod configured and sized to directly engage an abdomen of said user, who may exercise by pulling himself/herself forwards and backwards relative to said handles while grasping said handles in a substantially upright position, and said rod being configured, positioned and sized to be displaced against a resistance of the spring element by the abdomen of the user as the user pulls himself/herself toward the handles.

16. A free-standing exercise device for exercising the abdominal muscles of a user being in a substantially upright position, comprising:

a. a base lower structure;

b. an upper structure connected to and located above the base lower structure, said upper structure having a substantially U-shaped member and a further member attached to and extending at an angle from each end of said U-shaped member;

c. a handle attached to the upper structure;

d. tensioning means extending from said upper structure; and e. a rod freely and tensively suspended by said tensioning means from said upper structure, said rod being suspended along a horizontal plane vertically lower than the horizontal plane passing through said handle, said rod further being suspended in a spaced-apart position between said handle and a position to be assumed by said user, said rod being configured, positioned and sized to directly engage an abdomen of said user, who may exercise by pulling himself/herself forwards and backwards relative to said handle while grasping said handle in a substantially upright position, and said rod being configured, positioned and sized to be displaced against a resistance of the tensioning means by the abdomen of the user as the user pulls himself/herself toward the handles.

* * * * *